US005157792A

United States Patent [19]

Allen et al.

[11] Patent Number: 5,157,792

[45] Date of Patent: Oct. 27, 1992

[54] BODY ARMOR VEST AND METHOD OF MANUFACTURE

[76] Inventors: Cheryl K. Allen; Richard W. Schoenweiss, both of P.O. Box 4112, Enterprise, Fla. 32725

[21] Appl. No.: 799,361

[22] Filed: Nov. 27, 1991

Related U.S. Application Data

[63] Continuation of Ser. No. 642,711, Jan. 17, 1991, abandoned, which is a continuation of Ser. No. 402,215, Sep. 1, 1989, abandoned.

[51] Int. Cl.[5] ..... F41H 1/02

[52] U.S. Cl. ..... 2/243 R; 2/25; 2/92; 2/95

[58] Field of Search ..... 2/2.5, 92, 95, 102, 2/103, 243 R, 248, 249, 250

[56] References Cited

U.S. PATENT DOCUMENTS

| | | | |
|---|---|---|---|
| 317,693 | 5/1885 | Wilde | 2/92 |
| 1,739,112 | 12/1929 | Wisbrod | 2/102 X |
| 2,077,153 | 4/1937 | Lipshie | 2/247 |
| 2,336,398 | 12/1943 | Horowitz | 2/247 X |
| 2,690,565 | 10/1954 | Cornet | 2/103 X |
| 2,743,446 | 5/1956 | Persico et al. . | |
| 2,954,563 | 10/1960 | De Grazia . | |
| 3,398,406 | 8/1968 | Waterbury | 2/2.5 |
| 3,973,275 | 8/1976 | Blauer | 2/2.5 |
| 4,266,297 | 5/1981 | Atkins | 2/2.5 |
| 4,466,135 | 8/1984 | Coppage, Jr. | 2/2.5 |
| 4,485,491 | 12/1984 | Rasmussen | 2/2.5 |
| 4,507,802 | 4/1985 | Small | 2/247 X |
| 4,754,500 | 7/1988 | Brucato et al. | 2/49 R |
| 5,073,985 | 12/1991 | Stone et al. | 2/2.5 |

FOREIGN PATENT DOCUMENTS

| | | | |
|---|---|---|---|
| 21622701 | 12/1971 | Fed. Rep. of Germany | 2/2.5 |
| 2214405 | 1/1988 | United Kingdom | 2/2.5 |

*Primary Examiner*—William A. Cuchlinski, Jr.
*Assistant Examiner*—Scott W. Cummings
*Attorney, Agent, or Firm*—Warren L. Franz

[57] ABSTRACT

A ballistic panel carrier vest with front and rear ballistic panel carrying pockets and a trauma plate pocket has front, rear and side portions, as well as epaulets, breast pockets with flap closures and buttoned placket front opening that look like the same elements of an underlying shirt so that the fact of wearing the vest is concealed. The vest is made from a shirt of the type over which it will be worn by cutting off the collar and sleeves, and either cutting the shirt tail off at the waist or folding it under. Loose edges of epaulets, breast pocket flaps and placket are sewn down.

8 Claims, 3 Drawing Sheets

BODY ARMOR VEST AND METHOD OF MANUFACTURE

This is a continuation of U.S. patent application Ser. No. 07/642,711, filed Jan. 17, 1991 and now abandoned, which is a continuation of U.S. patent application Ser. No. 07/402,215, filed Sep. 1, 1989 and now abandoned.

BACKGROUND OF THE INVENTION

This invention relates to protective body armor in general; and, more particularly, to a ballistic panel carrier vest for inconspicuous wear over conventional attire, such as over a standard uniform shirt, as well as a method of making the same.

Body armor wear of the type to which the present invention relates is shown in U.S. Pat. Nos. 3,973,275; 4,266,297; 4,466,135; and 4,485,491. Such garments, commonly referred to as "bullet proof vests," take the form of carriers for the containment and positioning of ballistic panels to protect the torso of the wearer from the impact of projectiles.

A well-known version of such a vest is shown by the armored garment of U.S. Pat. No. 3,973,275 to Blauer. The Blauer Vest is a lightweight flexible garment intended to be unobtrusively worn under ordinary clothing by military personnel, civilian law enforcement authorities, and the like, to protect against sudden, unexpected handgun attack. The vest comprises a plurality of panels of KEVLAR or similar soft mid flexible ballistic fabric material, enclosed within a durable outer covering and joined together to completely encircle the wearer's torso so as to provide protection against attack from any direction.

The back of the vest comprises a panel that extends down from the shoulders to the waist and forwardly partway around both sides. The back panel is yoked at the shoulders to accommodate the neck. The front of the vest has two panels that extend down from the shoulders over left and right lateral portions of the chest and ribs to the waist and rearwardly partway around the respective sides. The panels are joined together in encircling positions about the torso by strips of VELCRO or the like hook and pile fastening material. The front panels in Blauer overlap to provide added protection in the central region of the chest to give added protection to vital organs, such as the heart, against close frontal attack. Other vests of the type to which the invention relates provide the same added protection by the use of a front subsidiary pocket into which an armor plate, sometimes referred to as a "trauma" plate, is placed.

The Blauer type vest resembles the flak or fragmentation jacket of ballistic textile material known for military use to be worn over a standard military uniform shirt. A desirable objective of body armor vests for use in civilian law enforcement activities, however, is that they be inconspicuous. If the vest is not concealed from view, an attacker will aim at the head and exposed parts of the body rather than the torso, thereby defeating the effectiveness of the protective function of the garment. For this reason, vests like the Blauer vest are normally worn underneath a standard law enforcement uniform shirt or concealed by means of a jacket or other outer garment. This makes them uncomfortable for full time, routine duty wear in hot weather and also interferes with the ease and rapidity with which the vest may be donned and doffed as necessary. The vests may also snag or bind on the outer clothing, thereby inhibiting free body movement by the wearer.

U.S. Pat. Nos. 4,266,297 to Atkins and 4,485,491 to Rasmussen are illustrative of attempts to improve on wearer comfort and mobility by providing a protective garment that closely resembles a standard law enforcement uniform shirt, so that it may be worn in place of the standard shirt, thereby entirely eliminating the need for a separate vest. The shirt-like garment is formed with internal front and rear pockets adapted to receive front and rear ballistic panels. The garment is donned as with any conventional uniform shirt by placing arms in the sleeves and closing a vertically extending buttoned or zippered placket which runs centrally, vertically down the front of the shirt and may be worn with or without the panels installed, as desired. However, while the single garment arrangement of Atkins and Rasmussen may offer some advantages to the wearer over the conventional under the shirt vest arrangement, the addition to or removal from the garment of the panels is cumbersome and will usually require that the shirt be taken off completely. For a law enforcement officer in a hot climate who would normally want to travel in a police cruiser with the back panel of such garment removed for driving comfort, the shirt removal procedure would be a great inconvenience. As a consequence, the panels would either be left in when not needed, to the detriment of the driving comfort and mobility of the officer, or would be left out when needed, to the detriment of the officer's safety.

U.S. Pat. No. 4,466,135 to Coppage, Jr., discloses a body armor vest in the form of a separate panel carrier garment, whose front is made to resemble the front bib portion of a standard dress shirt, so that when it is worn over the dress shirt with the collar and necktie of the underlying shirt protruding over the protective vest, the vest will blend with the shirt to look like part of it. To simulate the bib portion of the shirt, the front of the vest is provided with buttons and a pocket. The multipiece, multiple layer construction of Coppage, Jr., with releasable connections at the shoulders and multiple hook and pile connections does not have the simple shirt-like strength and simplicity of the one-piece Atkins arrangement. Moreover, unlike the Atkins arrangement, the Coppage, Jr. vest is likely to conceal its body armor nature only when worn under a jacket or other outer covering that conceals the shoulder and side connections. And, as with Atkins, the tail on the vest may snag to shift the panel positions when the wearer turns.

SUMMARY OF THE INVENTION

It is an object of the present invention to provide a ballistic panel carrier vest suitable for wear over a shirt, such as a standard uniform shirt, that can be readily donned and doffed at will, and whose appearance sufficiently resembles that of the underlying shirt as to render the vest unobtrusive to the casual observer.

It is a further object of the present invention to provide a method of manufacture of such a ballistic panel carrier vest from a shirt, such as a standard uniform shirt, over which the vest can be unobtrusively worn.

In one aspect of the invention a ballistic panel carrier vest suitable for unobtrusive wear over a shirt, such as a standard uniform shirt, has integrally formed front, rear and side portions with outer surfaces which look like the corresponding normally visible outer surfaces of corresponding portions of the underlying shirt. Front and rear pockets are formed internally of the vest to hold front and rear ballistic panels in front and rear torso protecting positions.

In a preferred embodiment of the invention, the vest is formed with a V-neck opening through which the collar of the underlying shirt may be brought and folded over to conceal the opening. The vest is made sleeveless with arm openings that fall just short of the circumferential sleeve seams of the underlying shirt and which are elongated downwardly to maximize the freedom of movement of the sleeves. For use with an underlying shirt having shoulder epaulets, a fly front opening buttoned placket closure, and breast pockets with flap closures, the vest has corresponding similar elements to enable the vest to blend in and appear to the casual observer as part of the underlying shirt. Loose edges of epaulets, placket closure and breast pocket flaps on the vest are sewn down to reduce their grasping by an assailant.

In another aspect of the invention, a vest for wear over a standard uniform shirt is manufactured from such a shirt by removing the collar and sleeves, and sewing down loose edges of material. The front opening of the standard shirt is sewn permanently closed, and a size adjustable side opening is added which extends from an arm opening to the lower edge of the shirt. The ballistic panel pockets are formed by sewing layers of material to the inside surfaces of the front and back portions of the converted shirt. In one example, described in detail below, the pockets are formed from upper and lower portions of an inner layer which is sewn to the inside of the shirt material except where they overlap. The overlap serves as an opening for inserting the panels into the pocket. The pockets are made closable by providing facing surfaces which are provided with releasable closure means. In another example, the lower portion of each pocket is formed by folding the bottom of the shirt inwardly at its waist.

Additional details of the invention and of preferred embodiments thereof are set forth below.

BRIEF DESCRIPTION OF THE DRAWINGS

Embodiments of the invention have been chosen by way of example for purposes of illustration and description, and are shown in the accompanying drawings, wherein.

Throughout the drawings, like elements referred to by like numerals.

DESCRIPTION OF THE PREFERRED EMBODIMENTS

Figure 1:
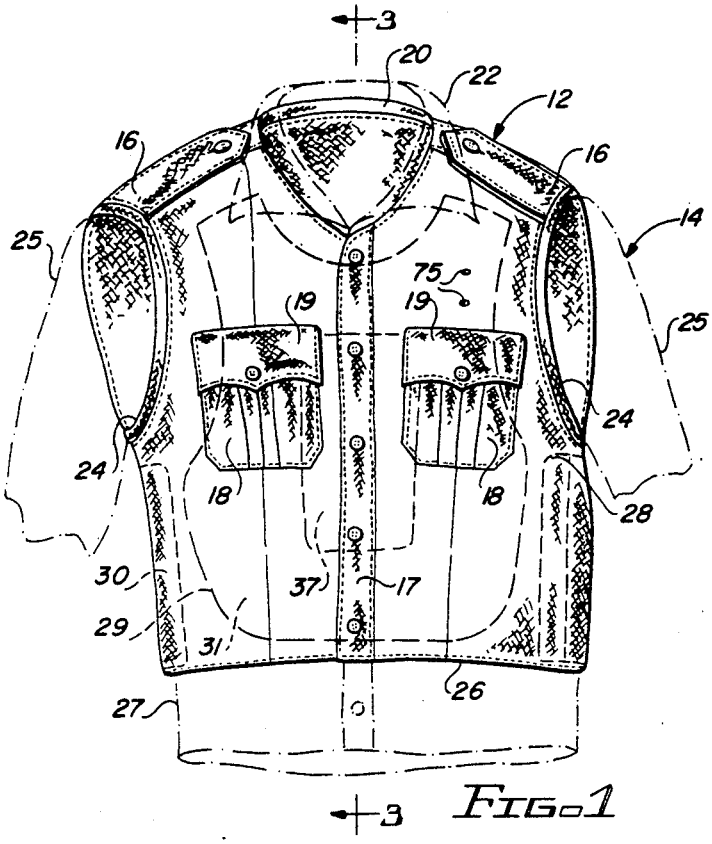
FIG. 1 is a front elevation view of a body armor vest in accordance with the invention, shown worn over a standard uniform shirt.
Figure 3:
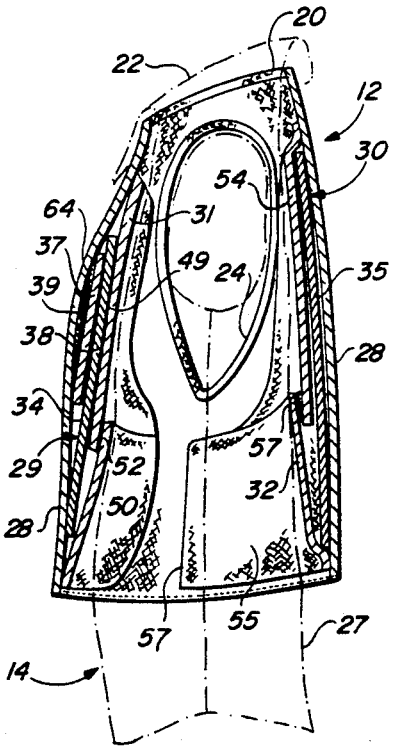
FIG. 3 is a section view taken along the line 3—3 in FIG. 1.
Figure 2:
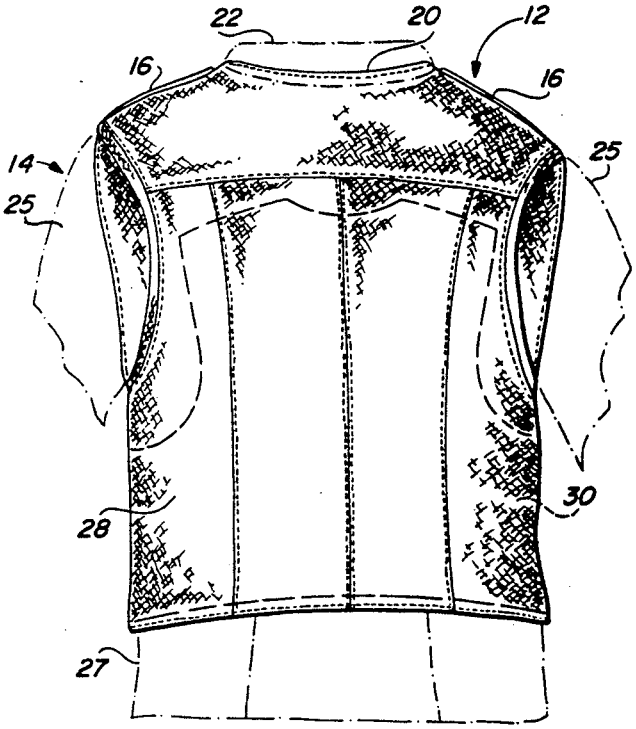
FIG. 2 is a rear elevation view of the vest of FIG. 1.

The principles of the invention are illustrated, by way of example, embodied in the form of a body armor vest 12 shown in FIGS. 1-3, usable in combination with a standard uniform shirt, such as a conventional law enforcement uniform dress shirt 14 indicated by dot-dash lines. The vest 12 is configured to resemble the underlying shirt 14 and includes shoulder epaulets 16, a front buttoned placket 17, and right and left front breast pockets 18 with flap closures 19 that are identical in appearance to corresponding elements of shirt 14. The vest 12 is provided with a yoke opening 20 at the neck through which the neck of the shirt 14 protrudes and which is concealed beneath the tuck of the underlying shirt collar 22. The vest 12 is sleeveless and includes left and right arm openings 24 through which left and right sleeves 25 of shirt 14 are extended. The vest 12 is tailored so that its lower edge 26 will be positioned just above and adjacent to the wearer's gun belt, with the tail 27 of the shirt 14 depending therebelow to be tucked in at the waist in a customary manner.

Figure 4:
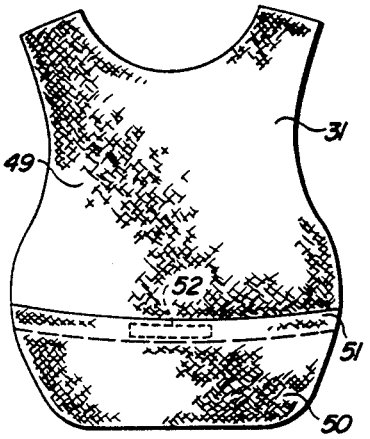
FIG. 4 is a rear elevation view of the fabric layer forming the interior of the front ballistic panel pocket of the vest of FIG. 1.
Figure 5:
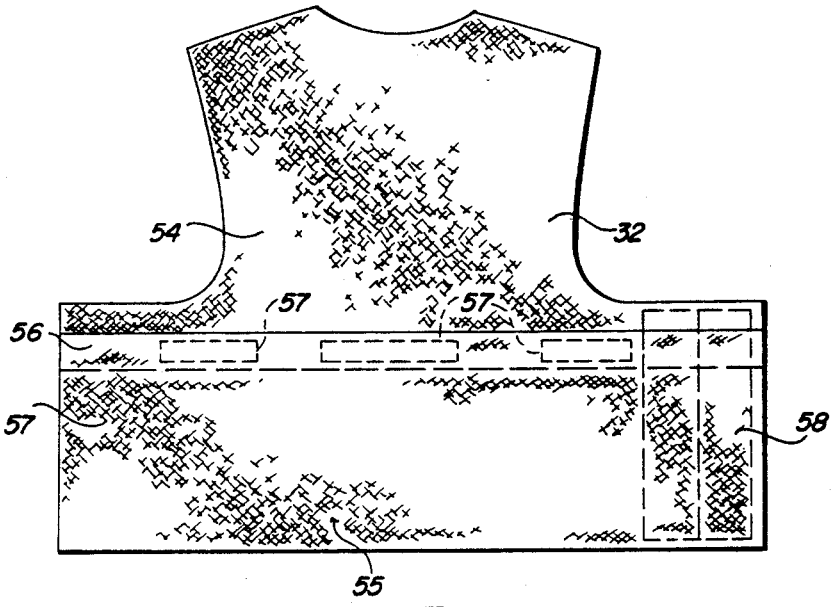
FIG. 5 is a rear elevation view of the fabric layer forming the interior of the rear ballistic panel pocket.

The vest 12 is accommodated to have front and rear pockets 29, 30, as shown, respectively, formed between the inside faces of an outer layer of fabric 28 of the front and rear of the vest 12 and inner fabric layers 31, 32 respectively attached thereto which have the configurations shown in FIGS. 4 and 5. The front pocket 29 is dimensioned to serve as a carrier for a flexible ballistic panel 34 (see FIG. 3) that extends over the front of the wearer's torso, from the shoulders down over the lateral portions of the chest and ribs to the waist. The pocket 29 is formed to have the same general configuration as the panel 34. The rear pocket 30 is likewise dimensioned to serve as a carrier for a flexible ballistic panel 35 of the same general configuration as the rear pocket 30 that extends over the back of the wearer's torso, from the shoulder down to the waist, and which includes left and right forwardly directed lateral extensions that cover the sides of the wearer from just below the arms to the waist. The pocket 30 is formed to have the same general configuration as the panel 30. A third pocket 37 is optionally located centrally, intermediate the layer 31 and the front of the vest 12. The pocket 37 is defined by a rectangular fabric layer 38 (FIG. 6), and is dimensioned and configured to serve as a carrier for a "trauma" armor plate which can be contained therein to provide supplemental protection to vital organs like the heart.

The vest 12 may suitably be fabricated from a standard uniform shirt identical to, though perhaps one-half size or so larger than, the underlying shirt 14. The sleeves are removed and sleeve openings 24 are cut back slightly to fall short of the double layer of fabric at the armhole seams of the underlying shirt 14. This will avoid a bulge at the armholes and better blend the vest 12 in with the contours of the shirt 14. The arm openings 24 are also slightly vertically elongated in the downward direction below the arms to give full freedom of movement to the sleeves 25. Ribbing, such as a hemming margin 41 (FIG. 8), may be added peripherally of the circumference of each opening 24 to help maintain the shape of the opening.

Figure 8:
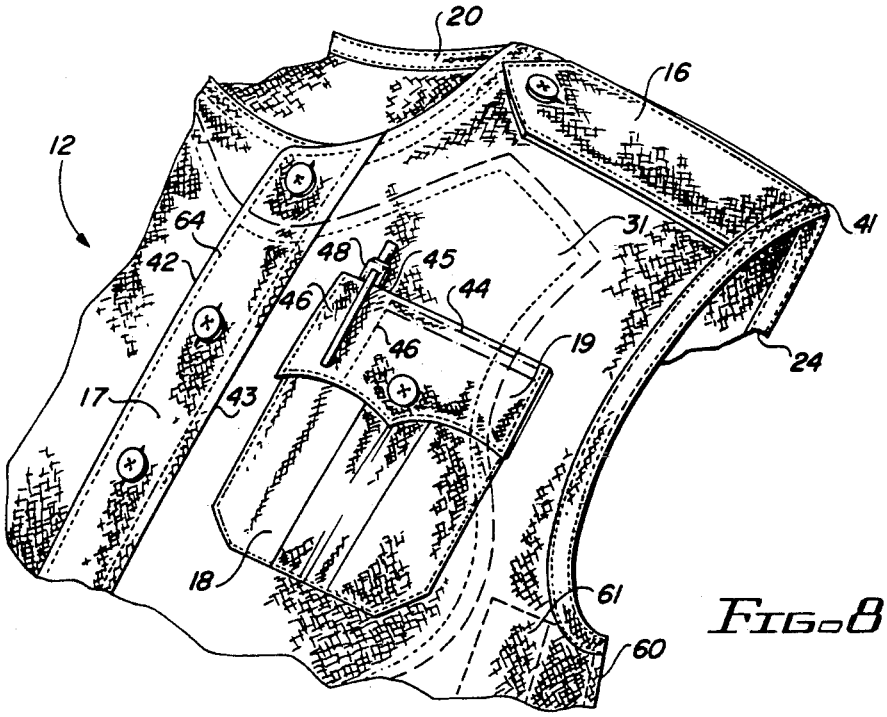
FIG. 8 is an enlarged fragmentary view of the vest showing details of the stitching.

The fly front opening of the standard shirt, which has the buttoned placket closure 17 is sewn permanently shut and vertical stitching is added as shown in FIG. 8 to hold the opposite vertical free edges 42, 43 of the placket 17 down. Stitching is also added perimetrically to the epaulets 16 and pocket flaps 19 to eliminate loose pieces of fabric material on the outside of the vest 12 that might otherwise be grabbed by an assailant during a confrontation with the wearer. The corner of the top edge of the pocket flap 19 which may come with a conventional partial stitching 44 (shown in dot-dashed lines in FIG. 8) may be left with an unstitched edge seam portion 45, if desired, so that the added pocket flap stitching 46 does not interfere with placement of a pen or similar writing implement 48 into the pocket 18, as shown. The retention of this natural function of the pocket, while adding stitching 46 to sew down the otherwise loose flap 19, contributes advantageously to presenting the converted shirt vest 12 as an integral part of the underlying identical pattern shirt 14.

The neck of the vest 12 is formed by removing the collar and neckband of the converted shirt to form a V-neck yoke opening 20 which extends down in the front suitably to a point located between the collar button and first front placket button of the underlying shirt 14. The collar button on the converted shirt is removed, but the remaining buttons of the placket closure 17 above the waist are kept to enhance the natural appearance of the vest 12. The portion of the tail below the waist is removed to a part about ¼ to ½ inches above the top of the gun belt in order that the finished vest 12 will not interfere with the gun belt or freedom of movement of the wearer.

A layer of fabric 31 having upper and lower portions 49, 50 (see FIG. 4), partially overlapping along a horizontal closure line 51, is sewn to the inside front surface of the standard uniform shirt being converted in the position generally shown by dashed lines in FIG. 1. The portions 49, 50 are stitched to the shirt along their peripheral edges except at the line 51, and matching VELCRO or similar hook and pile releasable closure elements 52 are affixed to the facing surfaces of the portions 49, 50 along the juncture 51. The size of the fabric layer 31 constituted by the portions 49, 50 is chosen to match the size of a conventional front flexible ballistic panel and the layer 31 is attached to the inside surface of the front of the converted uniform shirt in such manner as to form the pocket 29 to contain the panel 34 over the wearer in its normal front torso protecting position. The hook and pile closure elements 52 provide a releasable closure along the line 51 for insertion and removal of the panel 34 from the pocket 29.

In similar fashion, the fabric layer 32 is comprised of upper and lower portions 54, 55, which overlap along a line 56 and have hook and pile elements 57 located on facing surfaces to form a releasable closure for insertion and removal of a conventional back panel of ballistic material 35 (FIG. 3). The layer 32 is configured to match the contour of the panel 35 and is sewn along peripheral edges of the portions 54, 55, except along the line 56, to provide the pocket 30 in the position indicated in FIG. 2 for positioning the panel 35 in its normal back torso protecting position. The layer 32 includes two forwardly directed lateral extensions 57, 58 in order to accommodate corresponding forwardly-directed lateral extensions of the panel 35 which are positioned to shield the torso area between the arms and waist or the sides of the wearer. The layers 31 and 32 are suitably formed from the same material as the uniform shirt being converted and thread is chosen to match the color of the shirt.

Figure 7:
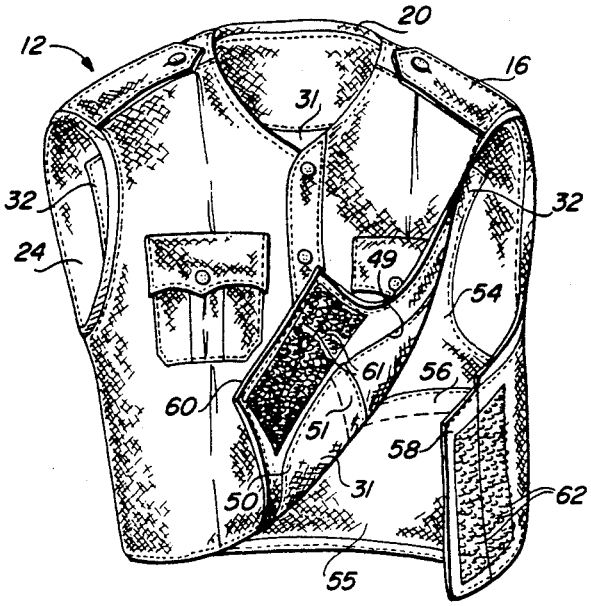
FIG. 7 is a front view of the vest of FIG. 1 showing the releasable closure thereof.

The converted shirt is slit vertically on one side from the bottom of the arm opening 24 to the waist to provide ready means for donning and doffing the vest (see FIG. 7). One surface of the front of the converted shirt adjacent the slit 60 is provided with one element of a conventional releasable fastening means, such as a strip of hook and pile fastening material 61. The other surface of the back of the converted shirt adjacent the slit 60 is provided with a complementary element 62 which cooperates with the element 61. The forwardly directed extension 58 of the layer 32 is preferably extended beyond the slit 60 and also provided with a like element 62 to permit the shirt to be releasably closed along the line 60 in an adjustable manner.

Figure 6:
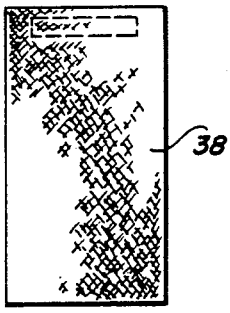
FIG. 6 is a rear elevation view of the fabric layer forming the interior of the trauma plate pocket.

A fabric layer 38 of the same material, shown in FIG. 6, may be added intermediate the layer 28 of the front of the converted shirt 12 and the fabric layer 31, to provide the pocket 37 centrally at the front of the wearer's chest, as indicated in FIG. 1. The pocket 37 is suitably formed by stitching bottom and left and right sides of the layer 38 to the front inside surface of the layer 28, leaving the top edge of the layer 38 unconnected to form a top opening to the pocket 37 through which the trauma plate 39 can be inserted (FIG. 3). Adjacent facing surfaces of the layers 28 and 38 can be fitted with complementary hook and pile elements 64, as with the panels 31, 32, to form a releasable closure at the pocket opening. The layer 38 may be sized to accommodate any size of trauma plate 39.

Figure 9:
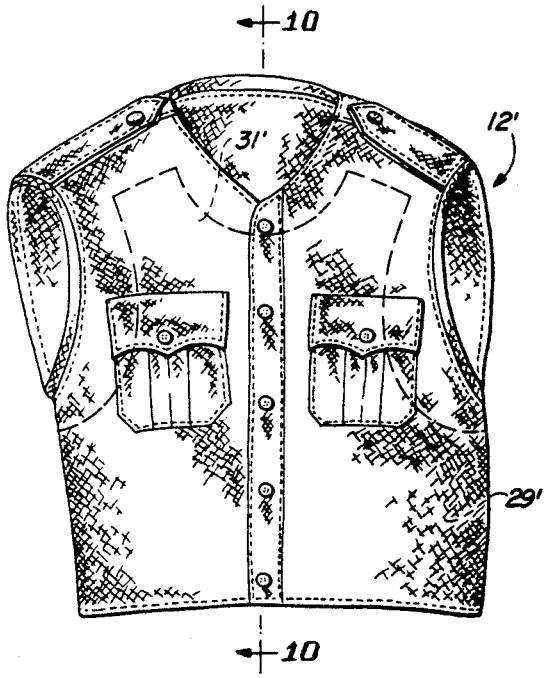
FIG. 9 is a front elevation view of a modified form of vest in accordance with the invention.
Figure 10:
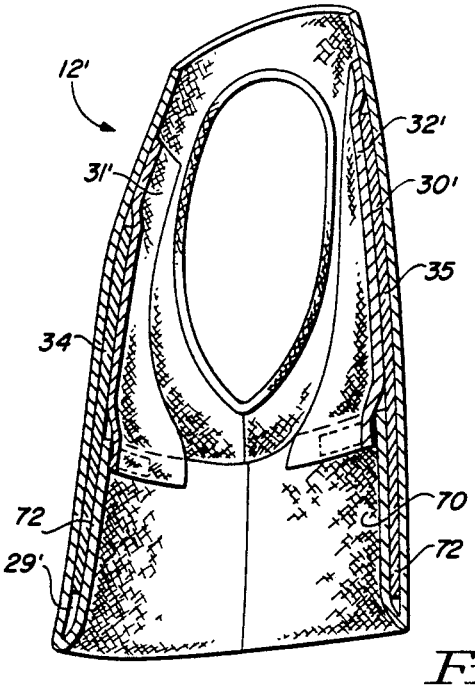
FIG. 10 is a section view taken along the line 10—10 in FIG. 9.

A modified form of the vest 12 is illustrated by the vest 12′ shown in FIGS. 9 and 10. As indicated, the front and rear pockets 29′, 30′ of the vest 12′ are distinguished from the pockets 29, 30 of the vest 12 in that the sewn-in layers 31′, 32′ comprise only upper portions corresponding to the portions 49, 54, respectively, of the layers 31, 32 of the vest 12. The lower portions formed by the portions 50, 55 in vest 12 (see FIGS. 4 and 5) are conveniently formed instead by folding a bottom tail section 70 of the converted shirt 12′ inwardly and upwardly at the waist and sewing the same in that position to form a continuous lower pocket portion 72 (FIG. 10) which is common to both pockets 29′ and 30′. This common lower pocket portion 72 has the advantage that forwardly extending portions of the back ballistic panel 35 are now free to move into and out of overlapping positions with respect to similar rearwardly extending portions of the front panel 34 at the non-slit side of the vest 12′, to accommodate changes in waist diameter adjustments the closure 61, 62 at the slit 61 side (see FIG. 7) of the vest. This helps to maintain the uninterrupted barrier of protection of the panels 34, 35 for different sized individuals who wear the same shirt size.

In use, the vest 12 or 12′ can be rapidly donned by a wearer of a standard uniform shirt 14 by opening the closure at slit 60 and placing the vest over the wearer's head on top of the shirt 14, with the one arm extending through the unslit opening 24 and the other arm extending through the slit arm opening 24. The fastening elements 61, 62 are then mated to close the vest in a comfortable position with the front, back and shoulders of vest 12 or 12′ overlying the front, back and shoulders of the underlying shirt 14; however, with the bottom of the vest 12 or 12′ lying just above the gun belt, while the bottom of the shirt 14 is tucked in at the waist. The collar of the shirt 14 is then folded over the yoke opening 20 of the vest to assume a normal collar position concealing the opening 20. Any shield, badge, nameplate or similar identifying insignia on the shirt 14 can be either transferred to the vest 12 or 12' such as by attachment to reinforced apertures 75 (FIG. 1) of the vest 12, 12', or a duplicate insignia can be left in position on the vest.

Worn in combination with the underlying conventional uniform shirt 14, a vest 12 or 12' in accordance with the invention forms an integral identical appearance with the shirt so that its body armor nature is not apparent in the absence of close scrutiny. Collar insignia (not shown) of the underlying shirt 14 remain visible as the collar 22 is folded over the yoke opening 20. The epaulets 16, placket 17 and pocket flaps 19, which are identical in appearance to those of the underlying shirt, are stitched down at loose edges so that they cannot be readily grabbed by an assailant. The flaps 19 of the pockets 18 (FIG. 8) are stitched so that a pen 48 can still be inserted. To take off the vest 12, 12', the closure at slit 60 is merely opened at the fastener 61, 62 and the vest is lifted over the wearer's head and the wearer's arm drawn out of the unslit arm opening 24.

A body armor vest in accordance with the invention, thus, provides a comfortable, inconspicuous carrier for flexible ballistic panels to provide protection against handgun assault. The simple, one-piece construction with a single, readily releasable and size adjustable side closure permits the vest to be quickly and easily donned and doffed at will by the user, thereby providing a welcome addition to the equipment of law enforcement officials and the like, especially in hot climates.

The foregoing detailed description of exemplary preferred embodiments is provided merely by way of illustration of the features, benefits and advantages of the invention, and not by way of limitation. Those skilled in the art to which the invention relates will appreciate that various substitutions and modifications may be made to the described embodiments without departing from the spirit and scope of the invention which is defined by the claims below.

We claim:

1. A method of making a ballistic panel carrier vest made from a standard uniform shirt formed of an outer layer of fabric and having integral front, back and side portions, said shirt further including a lower edge, a waist, first and second sleeves, a neck opening with a collar, and a front opening with releasable closure means, said method comprising:

removing said sleeves to define first and second arm openings; removing said collar to define a neck opening; securing said front opening in permanently closed position;

securing an inner layer of fabric to said outer layer of fabric at said front portion to define a front pocket adapted, configured and dimensioned to receive a front ballistic panel in a front torso protecting position therein; and securing an inner layer of fabric to said outer layer of fabric at said back portion to define a rear pocket adapted, configured and dimensioned to receive a back ballistic panel in a back torso protecting position therein.

2. A method as in claim 1, further comprising: forming a side opening in said outer layer of fabric between said first arm opening and said lower edge; and providing releasable closure means at said side opening.

3. A method as in claim 2, further comprising: securing an intermediate layer of fabric to said outer layer of fabric between said front portion and said inner layer of fabric secured to said front portion, to define a further pocket adapted, configured and dimensioned to receive a trauma plate in vital organ protecting position therein.

4. A method as in claim 1, wherein said shirt further comprises pieces of fabric material loosely connected to said outer layer of fabric to leave unsecured edges, and said method further comprises securing said free edges to said outer layer to render said pieces less graspable.

5. A method as in claim 1, further comprising folding said outer layer inwardly from said lower edge to said waist to define a lower portion of said front and rear pockets.

6. A method as in claim 1, wherein said shirt further has a double layer of fabric at seams joining said sleeves to said front, back and side portions, and said sleeve removing step comprises cutting said sleeve openings back to fall short of said double layer of fabric.

7. A method as in claim 6, further comprising: adding ribbing peripherally of the circumference of each arm opening to help maintain the shape of the arm opening.

8. A method as in claim 1, further comprising elongating said sleeve openings in a downward direction.

* * * * *